US007770732B2

(12) United States Patent
Stroppolo et al.

(10) Patent No.: US 7,770,732 B2
(45) Date of Patent: Aug. 10, 2010

(54) BLISTER PACKAGING

(75) Inventors: Federico Stroppolo, Aldesago (CH); Sandro Lepori, Oggio (CH); Franco Ciccarello, Mezzovico (CH); Rita Milani, Canobbio (CH); Lorenzo Bellorini, Travedona Monate (IT); Davide Marchini, Bioggio (CH)

(73) Assignee: Alpex Pharma SA, Mezzovico (CH)

( * ) Notice: Subject to any disclaimer, the term of this patent is extended or adjusted under 35 U.S.C. 154(b) by 0 days.

(21) Appl. No.: 10/529,136

(22) PCT Filed: Oct. 2, 2003

(86) PCT No.: PCT/EP03/10949

§ 371 (c)(1),
(2), (4) Date: Mar. 23, 2005

(87) PCT Pub. No.: WO2004/031050

PCT Pub. Date: Apr. 15, 2004

(65) Prior Publication Data

US 2005/0258065 A1 Nov. 24, 2005

Related U.S. Application Data

(60) Provisional application No. 60/416,018, filed on Oct. 4, 2002.

(51) Int. Cl.
*B65D 83/04* (2006.01)

(52) U.S. Cl. ..... 206/532; 206/528; 206/534.1; 206/538

(58) Field of Classification Search ..... 206/528, 206/530, 532, 534, 538, 534.1
See application file for complete search history.

(56) References Cited

U.S. PATENT DOCUMENTS 3,630,346 A * 12/1971 Burnside ..... 206/532
3,780,856 A * 12/1973 Braverman ..... 206/534

(Continued)

FOREIGN PATENT DOCUMENTS

DE 2322055 A1 1/1975

(Continued)

OTHER PUBLICATIONS

Notice of Reasons for Rejection with English translation, dated Aug. 7, 2008 in Japanese patent application No. 2004-540773, 6 pages.

*Primary Examiner*—J. Gregory Pickett
(74) *Attorney, Agent, or Firm*—Rothwell, Figg, Ernst & Manbeck, P.C.

(57) ABSTRACT

A packaging includes a tray and a sheet. The tray has a series of spaced apart sections. Each spaced apart section is generally rectangular in shape and has a recessed compartment and an upper surface. The sheet is fixed in part to the upper surface of the tray and has a plurality of tab portions that are not fixed to the tray thereby creating a tab. Each tab portion corresponds to one of the spaced apart sections and has first and second ends. Each tab portion can be graduated in width from the first end to the second end. The first end can be positioned in a corner of the corresponding spaced apart section. The tab portion has a length measured parallel to the length of the corresponding spaced apart section and the second end is adjacent to the sealed portion of the sheet.

3 Claims, 2 Drawing Sheets

U.S. PATENT DOCUMENTS

| | | | | | |
|---|---|---|---|---|---|
| 3,924,746 | A | * | 12/1975 | Haines | 206/530 |
| 3,941,248 | A | * | 3/1976 | Moser et al. | 206/531 |
| RE29,705 | E | * | 7/1978 | Compere | 206/531 |
| 5,046,618 | A | * | 9/1991 | Wood | 206/532 |
| 5,620,088 | A | * | 4/1997 | Martin et al. | 206/5.1 |
| 5,775,505 | A | * | 7/1998 | Vasquez et al. | 206/538 |
| 5,785,180 | A | * | 7/1998 | Dressel et al. | 206/532 |
| 5,944,191 | A | * | 8/1999 | Ray et al. | 206/532 |
| 6,155,423 | A | * | 12/2000 | Katzner et al. | 206/531 |
| 6,375,956 | B1 | * | 4/2002 | Hermelin et al. | 424/400 |
| 6,830,153 | B2 | * | 12/2004 | French et al. | 206/538 |
| 2003/0111379 | A1 | * | 6/2003 | Intini | 206/531 |

FOREIGN PATENT DOCUMENTS

| | | |
|---|---|---|
| DE | 88 11 951 | 1/1989 |
| DE | 101 02 818 | 8/2002 |
| JP | 49-47079 | 7/1972 |
| JP | 58-192255 | 12/1983 |
| JP | 62-185262 | 11/1987 |
| JP | 51-86376 | 7/1993 |
| JP | 11-314667 | 11/1999 |

* cited by examiner

A-A

BLISTER PACKAGING

CROSS-REFERENCE TO RELATED APPLICATION

This application is a 371 national stage of PCT/EP03/10949 filed on Oct. 2, 2003, which claims the benefit of U.S. provisional application 60/416,018 filed on Oct. 4, 2002.

TECHNICAL FIELD OF THE INVENTION

This invention relates to packaging of goods, such as tablets, capsules or other solid pharmaceutical dosage forms. The package includes a lower tray for receiving such goods which are subsequently covered by a sheet which is sealed, in part, to the tray.

BACKGROUND OF THE INVENTION

Blister-type packaging is one of the more common forms of packaging for solid pharmaceutical dosage forms, particularly in Europe where blister-type packaging is more common. Also, blister packaging is used for certain dosage forms that cannot be exposed for any length of time to either moisture or light, or where the dosage form can be easily damaged.

In particular, blister-type packaging consists of a lower portion or "tray" which comprises a series of separate, spaced apart recesses. Each recess is sized to be slightly larger than the solid dosage form. Each recess typically receives a single dosage form. The solid pharmaceutical dosage forms are then protected within the recess by sealing the exposed or upper portion of the tray with a sheet in whole or in part.

The sheet may include metal, such as aluminum, depending on the extent of protection needed by the particular solid pharmaceutical dosage form. The sealing is typically a heat sealing process. The sealing of the sheet onto the tray is designed to prevent moisture and light from getting into the recess. Proper storage of solid dosage forms such as tablets and capsules is important in maintaining a level of quality for the stored product through the determined shelf life. If moisture and/or light get through to the dosage form, the shelf life of the dosage form may be significantly compromised, and the quality of the dosage form may be detrimentally effected. If this happens, the safety and/or efficacy of the dosage form may be compromised.

At present, the type of blister packs that require metallic laminates require a thick layer of the metal (in the range of 15 to 60 microns) to be effective. With this thickness, it then becomes difficult for the user to easily remove the tablet or capsule without damaging the tablet or capsule in the process in situations where the tablet or capsule is pushed through the aluminum layer. Thus, at present, many of existing metallic foil blister pack designs which effectively seal against moisture require the use of scissors to remove the metallic laminate seal from the recess in order to access the tablet or capsule. Patients having limited dexterity or strength, may not be able to safely remove the dosage form from the seal without significant risk to their safety. Moreover, even with the use of scissors or another sharp object, removal of the tablet or capsules intact also becomes a problem. Many tablets or capsules are not effective if taken when damaged. In addition, a scissors or knife or other sharp object is not always available for use, for example during air travel.

In addition to the thick metal layer, blister-type packaging at present often times requires the separation of the lower portion or tray into smaller subsections in order to access a tab or an unsealed edge from which to peel off the sealed layer.

Again, the separation of the tray into subsections may cause damage to the dosage forms contained therein or result in an unintentional opening of one or more recesses during the separation process. Moreover, it may be difficult or impossible for patients with limited dexterity or strength to separate the tray into the subsections.

A further limitation on the blister-type packaging of today involves the location of the unsealed area of the sheet. Many of the present designs do not provide a tab or free end that is easily accessible for all patients, including those with limited dexterity. Many of the present designs require a sufficient amount of agility to easily peel away the free area.

Thus, there is a need for an effective laminate seal against moisture and/or light that may be safely and manually removed by the user, including those having limited dexterity.

There is a further need for a blister pack having an easy means of removing the seal which will enable patients with limited dexterity to remove the seal without damaging the contents.

There is also a further need for a blister pack design that does not require physical separation of the blister compartments prior to removal of the seal.

SUMMARY OF THE INVENTION

The present invention is a packaging having a tray having at least one recess to receive contents therein and an upper layer, the packaging also having a manually removable sheet fixed in part to the upper layer of the tray and unfixed in part to the tray, the unfixed part of the sheet being in the form of a tab, the tab being located adjacent to one corner of the upper portion of the tray that forms the recess, whereby when the sheet is fixed to the tray it is an effective seal against moisture and light. The present invention further includes packaging having a peel off layer that may be manually removed for those with limited dexterity. The present invention also includes a tab having a graduated width for easy grasping by the patient. The present invention further provides for a tray that does not need to be separated into subsections prior to removal of the contents therein.

The claims 2 to 5 describe preferred embodiments.

BRIEF DESCRIPTION OF THE DRAWINGS

These and other features, aspects and advantages of the present invention will become better understood with regard to the following description, appended claims and accompanying drawings where:

and

Figure 3:
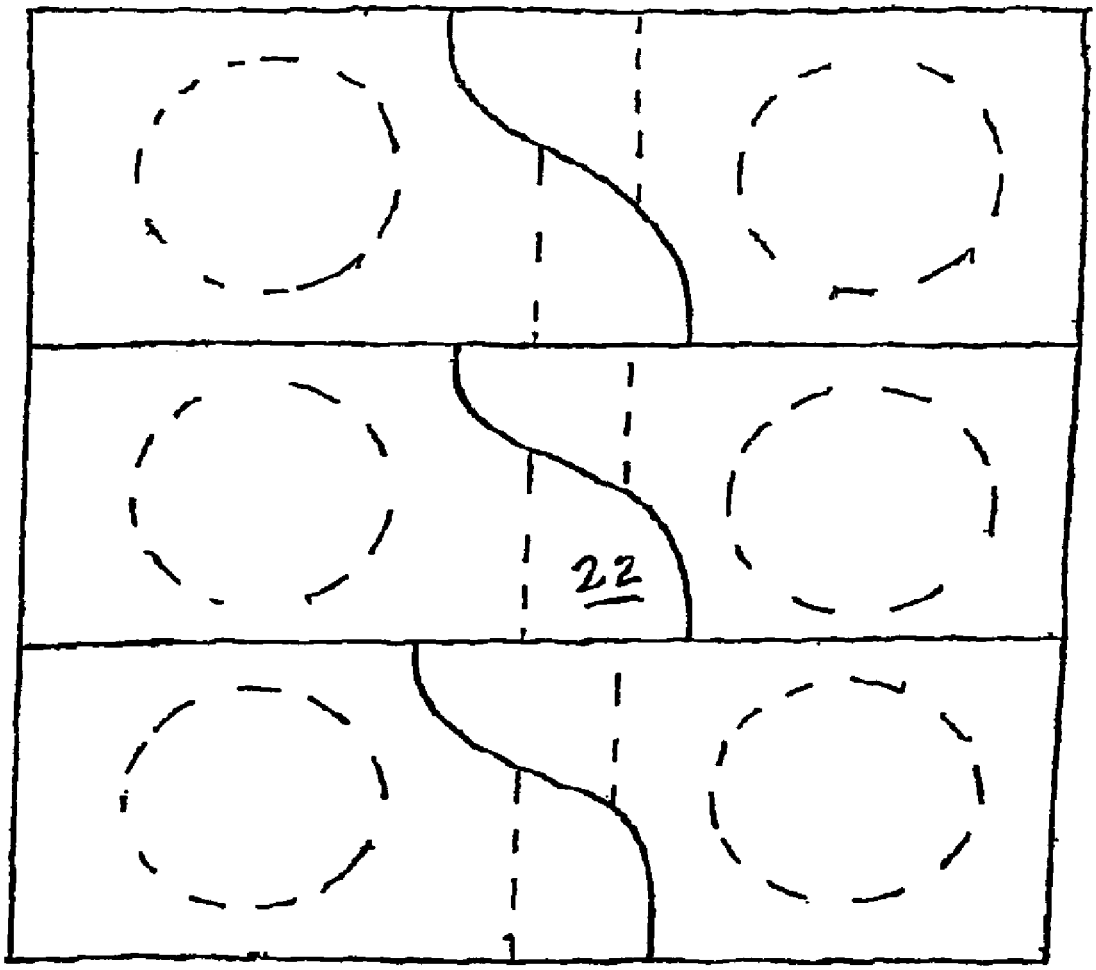

FIG. 3 is a plan view of a second embodiment of the present invention.

DESCRIPTION OF THE INVENTION

Figure 1:
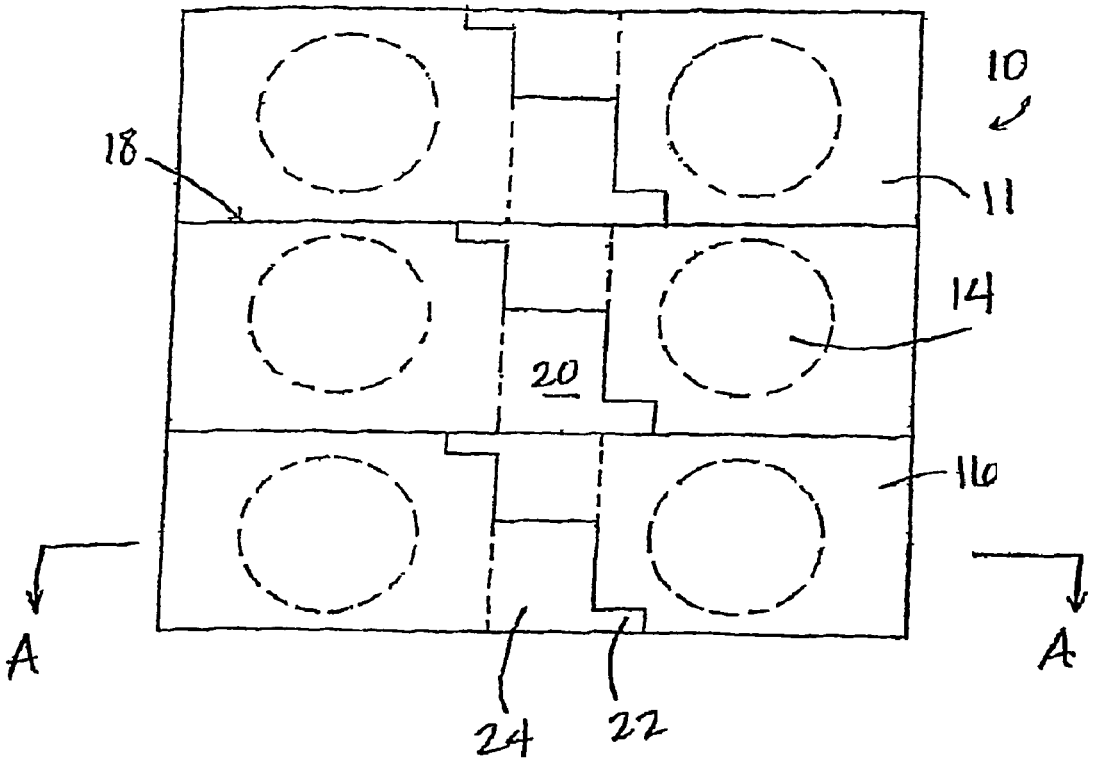
FIG. 1 is a plan view of a first embodiment of the present invention.
Figure 2:
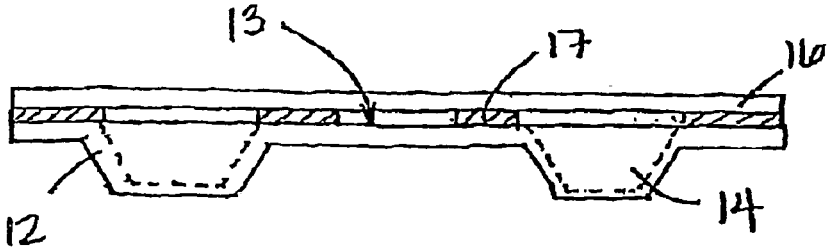
FIG. 2 is a section view along line A-A of the embodiment of FIG. 1.

The invention 10 is directed to a packaging system having a tray 12. The tray 12, shown in FIG. 2, has a series of separated, spaced apart sections 11, shown in FIG. 1. The spaced apart sections 11 are generally rectangular in shape. Each section has a recessed compartment 14 therein as shown in FIG. 1. The recessed compartments are sized to accommodate a particular size tablet or capsule or a combination of both or other solid pharmaceutical dosage form. The tray 12 also has an upper surface 13. Once the solid pharmaceutical dosage forms are placed in the tray 12, a thin, flexible sheet 16 is fixed in part to the upper surface 13 of the tray 12. This may be accomplished by the use of adhesive or heat sealing. Once the heat sealing or application of adhesive is completed, there is an adhesive layer 17 located between the upper layer 13 of the tray 12 and the sheet 16.

The tray 12 also has a series of perforations or cuts 18 to enable it to separate into smaller trays or single compartments. In addition, there are tabs 20 formed from a portion of the sheet that is not sealed to the upper layer. These are also shown in FIG. 1 and may vary in shape and size depending upon the particular tablet, capsule or other solid dosage form being packaged in the tray 12. In an exemplary embodiment, the spaced apart section 11 are formed in a matrix and the tab portions are formed in a center portion of the matrix such that tab portions for adjacent spaced apart sections are contiguous. Furthermore, the tab portions can be configured such that the direction of the widths of the second end of each of the tab portions are substantially parallel to one another. The tab 20 as shown, is graduated in width. The narrow tip 22 of the tab 20 enables a patient to easily separate the tab from the unsealed upper surface 13 of the tray 12. The increased width 24 of the tab 20 adjacent to the sealed upper surface 13 of the tray 12 aids the user in effectively peeling the tab and sealed sheet 16 away from the sealed upper surface of the tray. The tab 20 is located in one corner of the section 11 so that the user does not need to separate the sections of the tray 12 prior to peeling the tab away from the tray. In addition, the tabs 20 may be cut in a number of different ways to ease manufacturing time and minimize materials.

The sheet is effectively able to seal against moisture and light and enables a user to manually peel off the layer with ease without the need for scissors or any other sharp object and while accessing the contents in an undamaged form. It is preferred that the sheet thickness is between 15 and 60 microns. An example of the sheet is an extruded aluminum film provided by Burgopack—Italy film# 25PA-45-PVC60. Alternatively there are unextruded foils that may be applied using adhesive.

It is also noted that while FIG. 1 discloses a first embodiment of the present invention there are other ways of arranging the compartments and the tabs so as to maintain ease of use by the user but also to make manufacturing as easy and as inexpensive as possible. Another embodiment of the invention having curved shaped tabs 22 is set forth in FIG. 3.

While preferred embodiments of the present invention has been depicted and described, it will be appreciated by those skilled in the art that many modifications, substitutions and changes may be made thereto without department from the true spirit and scope of the invention.

What is claimed is:

1. An immediately available and removable packaging consisting of:

a tray having a series of spaced apart sections, each spaced apart section being generally rectangular in shape and having a recessed compartment and an upper surface;

a sheet fixed in part to the upper surface of the tray having a plurality of tab portions that are not fixed to the tray thereby creating tabs, each tab portion corresponding to one of said spaced apart sections and having first and second ends, each said tab portion being graduated in width from the first end increasing in width to the second end, said first end being positioned in a corner of the corresponding spaced apart section, said tab portion having a length parallel to a length of the corresponding spaced apart section, and said second end being adjacent to the fixed portion of the sheet of the corresponding spaced apart section.

2. The packaging system as recited in claim 1, wherein said spaced apart sections are formed in a matrix and said tab portions are formed in a center portion of said matrix such that tab portions for adjacent spaced apart sections are contiguous.

3. The packaging system as recited in claim 2, wherein the direction of the widths of the second end of each of the tab portions are substantially parallel to one another.

* * * * *